US010006298B2

(12) United States Patent
Walter et al.

(10) Patent No.: US 10,006,298 B2
(45) Date of Patent: Jun. 26, 2018

(54) TURBINE BLADE OF A GAS TURBINE AND METHOD FOR COATING A TURBINE BLADE OF A GAS TURBINE

(75) Inventors: Heinrich Walter, Friedberg (DE); Horst Pillhoefer, Roehrmoos (DE); Michael Strasser, Erdweg (DE); Karlheinz Manier, Scheyern (DE); Max Morant, Aschau (DE); Richard Lange, Markt Indersdorf (DE)

(73) Assignee: MTU Aero Engines GmbH, Munich (DE)

( * ) Notice: Subject to any disclaimer, the term of this patent is extended or adjusted under 35 U.S.C. 154(b) by 1300 days.

(21) Appl. No.: 12/877,007

(22) Filed: Sep. 7, 2010

(65) Prior Publication Data

US 2011/0058951 A1 Mar. 10, 2011

Related U.S. Application Data

(60) Provisional application No. 61/240,356, filed on Sep. 8, 2009.

(51) Int. Cl.

| | |
|---|---|
| ***B05D 3/02*** | (2006.01) |
| ***F01D 5/28*** | (2006.01) |
| ***F01D 5/30*** | (2006.01) |
| ***F01D 25/00*** | (2006.01) |
| ***C23C 10/32*** | (2006.01) |

(52) U.S. Cl.

CPC ..... *F01D 5/288* (2013.01); *C23C 10/32* (2013.01); *F01D 5/3092* (2013.01); *F01D 25/007* (2013.01); *F05D 2300/132* (2013.01); *Y10T 29/49337* (2015.01)

(58) Field of Classification Search

CPC ..... F01D 5/288; C23C 10/32
USPC ..... 427/380
See application file for complete search history.

(56) References Cited

U.S. PATENT DOCUMENTS

| | | | | |
|---|---|---|---|---|
| 5,071,678 | A * | 12/1991 | Grybowski | C23C 10/08 427/253 |
| 5,882,439 | A * | 3/1999 | Nakahama et al. | 148/240 |
| 6,110,262 | A * | 8/2000 | Kircher | C23C 10/26 106/14.21 |
| 6,224,941 | B1 * | 5/2001 | Chen et al. | 427/252 |
| 2007/0272331 | A1 * | 11/2007 | Strasser et al. | 148/279 |
| 2008/0245445 | A1 * | 10/2008 | Helmick | C23C 10/26 148/268 |

FOREIGN PATENT DOCUMENTS

| | | | | |
|---|---|---|---|---|
| EP | 1 111 192 B1 | | 6/2001 | |
| EP | 1111192 | * | 6/2001 | F01D 5/28 |
| WO | WO 2007147387 | * | 12/2007 | C23C 10/02 |

OTHER PUBLICATIONS

Merriam Webster Website, Lacquer, p. 1-3, Accessed Jun. 23, 2014.*

* cited by examiner

*Primary Examiner* — Tabatha Penny
(74) *Attorney, Agent, or Firm* — Crowell & Moring LLP

(57) ABSTRACT

A method for coating a turbine blade of a gas turbine is disclosed. The method includes applying a lacquer coat to a region of the turbine blade, where the lacquer coat includes chromium particles and/or chromium alloy particles, halides, and a binding agent. The method further includes drying the applied lacquer coat at a temperature between 50° C. and 600° C. with disintegration of the binding agent and subsequent reactive connection at a temperature between 900° C. and 1160° C.

11 Claims, 1 Drawing Sheet

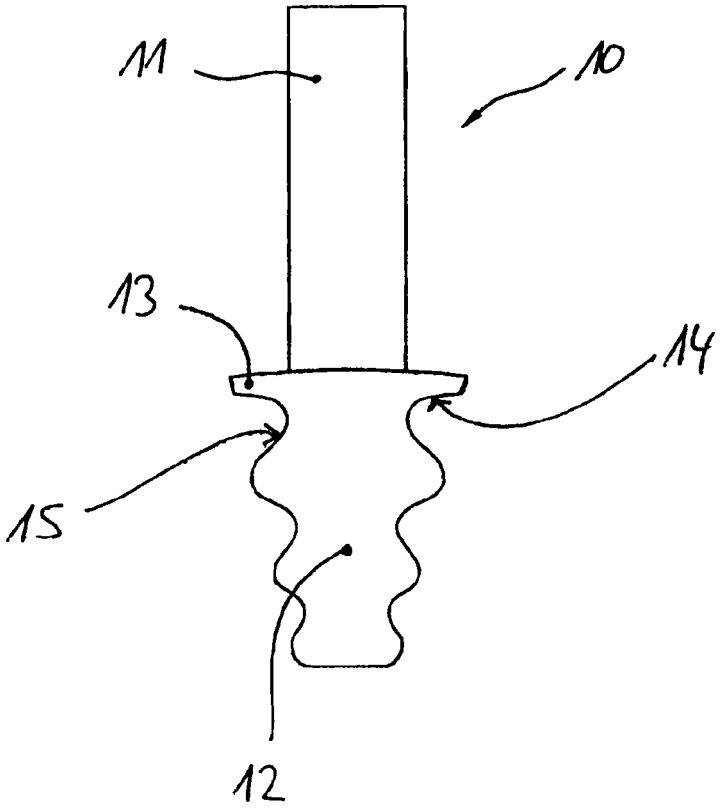
11
10
13
14
15
12

TURBINE BLADE OF A GAS TURBINE AND METHOD FOR COATING A TURBINE BLADE OF A GAS TURBINE

This application claims the benefit of U.S. Provisional Application No. 61/240,356, filed Sep. 8, 2009, the disclosure of which is expressly incorporated by reference herein.

BACKGROUND AND SUMMARY OF THE INVENTION

The invention relates to a turbine blade of a gas turbine. In addition, the invention relates to a method for coating a turbine blade of a gas turbine.

A turbine blade of a gas turbine and a method for coating a turbine blade of a gas turbine are known from European Patent Document No. EP 1 111 192 B1, wherein the turbine blade has a blade pan, a blade root, and a platform positioned between the blade pan and the blade root. This prior art document proposed that the turbine blade be coated with a wear protective coating on a lower side of the platform and on a transition region between the lower side of the platform and the blade root, namely with an anti-corrosive protective coating, wherein the wear protective coating is a MCrAlY overlay coating. This overlay coating features a chromium content of between 10% by weight and 40% by weight.

Starting herefrom, the objective of the present invention is creating a novel turbine blade of a gas turbine and a novel method for coating a turbine blade.

According to the invention, the anti-corrosion coating is a diffusion coating having a chromium content in the surface region of more than 30% by weight.

The method according to the invention, in an embodiment, includes at least the following steps: a) making a turbine blade available; b) applying at least one lacquer coat to at least one region of the turbine blade, wherein the lacquer includes chromium particles and/or chromium alloy particles, halides, and a binding agent; c) drying the applied lacquer at a temperature between 50° C. and 600° C. with disintegration of the binding agent; and d) subsequent reactive connection at a temperature between 900° C. and 1160° C.

The present invention makes it possible for the service life of turbine blades to be increased and for an effective protection against hot-gas corrosion or sulfidation to be realized, wherein this protection with respect to the base material of the turbine blade is increased by the factor of 6. A good coating can be guaranteed even with a complex contouring of the lower side of the platform and of the transition region between the lower side of the platform and the blade root.

Preferred further developments of the invention are disclosed in the following description. Without being limited hereto, exemplary embodiments of the invention are explained in greater detail on the basis of the drawing.

BRIEF DESCRIPTION OF THE DRAWING

The FIGURE is a schematic view of a turbine blade of a gas turbine.

DETAILED DESCRIPTION OF THE DRAWING

FIG. 1 shows a schematic depiction of a turbine blade 10 of a gas turbine configured as a rotor blade, wherein the turbine blade 10 includes a blade pan 11, a blade root 12, and a platform 13 positioned between the blade pan 11 and the blade root 12. The turbine blade 10 is coated with an anti-corrosion coating on a lower side 14 of the platform and/or on a transition region 15 between the lower side 14 of the platform 13 and the blade root 12.

In terms of the present invention, the anti-corrosion coating is a diffusion coating having a chromium content in the surface region of more than 30% by weight. The anti-corrosion coating in this case is configured as a graduated, ductile chromalized layer, whose chromium content in the surface region is preferably between 40% by weight and 95% by weight.

An α-chromium phase content with a chromium content of more than 30% by weight of the anti-corrosion coating in this case is between 5% by weight and 50% by weight. The remainder of the chromium content of the anti-corrosion coating is formed by other chromium phases and by chromium dissolved in a solid solution of the base material.

The α-chromium phase content of the chromium content of the anti-corrosion coating has a Vickers hardness of less than 800.

The total layer thickness of the anti-corrosion coating is between 5 μm and 120 μm, preferably between 15 μm and 50 μm.

The procedure when coating a turbine blade of a gas turbine in the region of the lower side 14 of the platform 13 and/or in the transition region 15 between the lower side 14 of the platform 13 and the blade root 12 is that first of all a turbine blade is made available.

After the turbine blade has been made available, at least one lacquer coat is applied to the lower side 14 of the platform 13 and/or the transition region 15 between the lower side 14 of the platform 13 and the blade root 12, wherein the lacquer includes chromium particles and/or chromium alloy particles, halides, and a binding agent.

The particle size of the chromium particles and/or chromium alloy particles in this case is in particular up to 20 μm. The halides of the lacquer are preferably metal chloride particles, in particular $CrCl_2$ particles and/or $CrCl_3$ particles. The binding agent of the lacquer is preferably configured with an acrylic base or glycol base or polyvinyl base.

The lacquer preferably has the following composition:

25 to 95% by weight binding agent;

0.1 to 10% by weight $CrCl_2$ particles and/or $CrCl_3$ particles; and the remainder chromium particles and/or chromium alloy particles.

To provide an aqueous dispersion, an acrylic acid ester or methacrylic acid ester, a methylcellulose compound, a polysaccharide, a polyvinyl alcohol, a polyvinyl ether, a polyvinyl acetate, a polyvinyl pyrrolidone or a colloidal silicic acid mixture may be used as a binding agent for the lacquer. A non-aqueous dispersion may also be made available as lacquer.

As already mentioned, at least one lacquer coat of this lacquer is applied to the lower side 14 of the platform 13 and/or the transition region 15 between platform 13 and blade root 12, preferably several lacquer coats are applied to these regions of the turbine blade, wherein each lacquer coat is applied with a layer thickness of between 2 μm and 50 μm. Preferably between one and ten lacquer coats are applied, in particular between three and six lacquer coats.

Following the application of the, or each, lacquer coat to the appropriate regions of the turbine blade, a drying of the applied lacquer is carried out at a temperature between 50° C. and 600° C. with disintegration of the binding agent. This drying is carried out in this case for a time period of between 5 min. and 240 min.

Following the drying of the lacquer, a reactive connection of the chromium particles and/or chromium alloy particles with molten chromium chloride particles is carried out at a temperature between 900° C. and 1160° C., wherein the reactive connection is carried out for a time period of between 15 min. and 15 hrs.

Following the reactive connection, diffusion annealing is preferably carried out on the pure chromium layer that formed at a temperature between 950° C. and 1200° C. for the in-diffusion of the chromium in the surface of the regions of the turbine previously coated with the lacquer, wherein in this case Cl compounds are preferably extracted.

The diffusion annealing is carried out for a time period of between 30 min. and 12 hrs. The diffusion annealing is preferably carried out in a hydrogen atmosphere or an inert gas partial pressure atmosphere with a pressure of between ambient pressure, i.e., approximately 1000 mbar, and 0.01 mbar.

The diffusion annealing is carried out preferably in a halide atmosphere, wherein then the hydrogen atmosphere or an inert gas partial pressure atmosphere features a gaseous addition of metal chloride particles, in particular of $CrCl_2$ particles and/or $CrCl_3$ particles. Argon is preferably used as the inert gas.

LIST OF REFERENCE NUMBERS

10 Turbine blade
11 Blade pan
12 Blade root
13 Platform
14 Lower side
15 Transition region The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for coating a turbine blade of a gas turbine, wherein the turbine blade has a blade pan, a blade root, and a platform positioned between the blade pan and the blade root, comprising the steps of:

applying a lacquer coat to a region of the turbine blade, wherein the lacquer coat includes chromium particles and/or chromium alloy particles, halides, and a binding agent;

wherein the lacquer coat has a composition of:

25% to 95% by weight binding agent;

0.1% to 10% by weight $CrCl_2$ particles and/or $CrCl_3$ particles;

and a remainder of the composition is the chromium particles and/or the chromium alloy particles;

drying the applied lacquer coat at a temperature between 50° C. and 600° C. with disintegration of the binding agent;

subsequent reactive connection at a temperature between 900° C. and 1160° C.; and diffusion annealing after the step of reactive connection, wherein the diffusion annealing is carried out in a halide atmosphere with a hydrogen atmosphere or an inert gas partial pressure atmosphere with a gaseous addition of $CrCl_2$ particles and/or $CrCl_3$ particles;

wherein a diffusion coating subsequent to the diffusion annealing has a chromium content in a surface region of the turbine blade between 40% by weight and 95% by weight.

2. The method according to claim 1, wherein the coating is an anti-corrosion coating and wherein the region is a lower side of the platform and/or a transition region between the lower side of the platform and the blade root.

3. The method according to claim 1, wherein the step of drying is carried out for a time period of between 5 minutes and 240 minutes.

4. The method according to claim 1, wherein the step of reactive connection is carried out for a time period of between 15 minutes and 15 hours.

5. The method according to claim 1, wherein 1 to 10 lacquer coats with a thickness of 2 μm to 50 μm per lacquer coat are applied.

6. The method according to claim 5, wherein 3 to 6 lacquer coats are applied.

7. The method according to claim 1, wherein the lacquer coat is an aqueous dispersion wherein an acrylic acid ester, a methacrylic acid ester, a methylcellulose compound, a polysaccharide, a polyvinyl alcohol, a polyvinyl ether, a polyvinyl acetate, a polyvinyl pyrrolidone, or a colloidal silicic acid mixture is used as the binding agent for the lacquer coat.

8. The method according to claim 1, wherein the lacquer coat is a non-aqueous dispersion.

9. The method according to claim 1, wherein the binding agent has an acrylic base or glycol base or polyvinyl base.

10. The method according to claim 1, wherein the step of diffusion annealing is carried out for a time period of between 30 minutes and 12 hours at a temperature between 950° C. and 1200° C.

11. A method for coating a turbine blade of a gas turbine, wherein the turbine blade has a blade pan, a blade root, and a platform positioned between the blade pan and the blade root, comprising the steps of:

applying a lacquer coat to a region of the turbine blade, wherein the lacquer coat includes chromium particles and/or chromium alloy particles, halides, and a binding agent;

wherein the lacquer coat has a composition of:

25% to 95% by weight binding agent;

0.1% to 10% by weight $CrCl_2$ particles and/or $CrCl_3$ particles;

and a remainder of the composition is the chromium particles and/or the chromium alloy particles;

drying the applied lacquer coat at a temperature between 50° C. and 600° C. with disintegration of the binding agent;

subsequent reactive connection at a temperature between 900° C. and 1160° C.; and diffusion annealing after the step of reactive connection, wherein the diffusion annealing is carried out in a hydrogen atmosphere or an inert gas partial pressure atmosphere with a gaseous addition of $CrCl_2$ particles and/or $CrCl_3$ particles with a pressure of between ambient pressure and 0.01 mbar;

wherein a diffusion coating subsequent to the diffusion annealing has a chromium content in a surface region of the turbine blade between 40% by weight and 95% by weight.

* * * * *